US008631774B2

(12) United States Patent
Fujiwaki et al.

(10) Patent No.: US 8,631,774 B2
(45) Date of Patent: Jan. 21, 2014

(54) VALVE TIMING CONTROL APPARATUS AND VALVE TIMING CONTROL MECHANISM

(75) Inventors: Kenji Fujiwaki, Kariya (JP); Masaki Kobayashi, Okazaki (JP); Yoshihiro Kawai, Obu (JP); Kenji Ikeda, Nagoya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/810,180

(22) PCT Filed: Jul. 7, 2011

(86) PCT No.: PCT/JP2011/065589
§ 371 (c)(1),
(2), (4) Date: Jan. 14, 2013

(87) PCT Pub. No.: WO2012/008354
PCT Pub. Date: Jan. 19, 2012

(65) Prior Publication Data

US 2013/0112161 A1 May 9, 2013

(30) Foreign Application Priority Data

Jul. 15, 2010 (JP) ..... 2010-160547

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS 5,823,152 A 10/1998 Ushida
5,836,277 A 11/1998 Kira et al.

(Continued)

FOREIGN PATENT DOCUMENTS

JP 11-132015 A 5/1999
JP 11-210424 A 8/1999

(Continued)

OTHER PUBLICATIONS

International Preliminary Report on Patentability (PCT/IB/338) and English Translation of Written Opinion of the International Searching Authority (PCT/ISA/237) in the corresponding International Patent Application No. PCT/ JP2011/065589.

(Continued)

*Primary Examiner* — Ching Chang
(74) *Attorney, Agent, or Firm* — Buchanan Ingersoll & Rooney PC

(57) ABSTRACT

A valve timing control apparatus includes a partitioning portion in a driven-side rotary member for partitioning the fluid pressure chamber into an advance angle chamber and a retard angle chamber, a restricting member in the driven-side rotary member and projectable and retractable relative to a driving-side rotary member, a restricting recess in the driving-side rotary member and restricting a relative rotational phase to a predetermined range in association with projection of the restricting member therein, a locking member disposed in the driven-side rotary member and projectable and retractable relative to the driving-side rotary member, a locking recess formed in the driving-side rotary member and locking the relative rotational phase to the predetermined phase in association with projection of the locking member therein, a communication passage formed between the restricting member and the locking member, and an urging passage for feeding fluid for projecting the restricting member into the restricting recess.

8 Claims, 12 Drawing Sheets

(56) References Cited

U.S. PATENT DOCUMENTS

| | | | | |
|---|---|---|---|---|
| 6,053,139 | A | 4/2000 | Eguchi et al. | |
| 6,739,298 | B2 | 5/2004 | Kusano et al. | |
| 7,497,193 | B2 * | 3/2009 | Knecht et al. | 123/90.17 |
| 8,360,022 | B2 | 1/2013 | Ozawa et al. | |
| 2002/0139332 | A1 | 10/2002 | Takenaka | |
| 2007/0144475 | A1 | 6/2007 | Suzuki et al. | |
| 2010/0050966 | A1 | 3/2010 | Ozawa et al. | |
| 2011/0168114 | A1 | 7/2011 | Kobayashi et al. | |
| 2012/0000437 | A1 | 1/2012 | Ozawa et al. | |

FOREIGN PATENT DOCUMENTS

| | | | |
|---|---|---|---|
| JP | 2000-002104 | A | 1/2000 |
| JP | 2002-357105 | A | 12/2002 |
| JP | 2003-286813 | A | 10/2003 |
| JP | 3918971 | B2 | 5/2007 |
| JP | 2007-198365 | A | 8/2007 |
| JP | 2009-203886 | A | 9/2009 |
| JP | 2010-138732 | A | 6/2010 |

OTHER PUBLICATIONS

International Search Report (PCT/ISA/210) issued on Aug. 2, 2011, by the Japanese Patent Office as the International Searching Authority for International Application No. PCT/JP2011/065589.

Written Opinion (PCT/ISA/237) issued on Aug. 2, 2011, by the Japanese Patent Office as the International Searching Authority for International Application No. PCT/JP2011/065589.

* cited by examiner (a)

(b)

(a)

(b)

(a)

(b)

(a)

(b)

(a)

(b)

(a)

(b)

(a)

(b)

(a)

(b)

VALVE TIMING CONTROL APPARATUS AND VALVE TIMING CONTROL MECHANISM

TECHNICAL FIELD

The present invention relates to a valve timing control apparatus and a valve timing control mechanism for controlling a relative rotational phase of a driven-side rotary member relative to a driving-side rotary member which is rotatable in synchronism with a crankshaft of an internal combustion engine.

BACKGROUND ART

Conventionally, there is known a valve timing control apparatus including a restricting mechanism which is provided separately from a locking mechanism for locking a relative rotational phase of a driven-side rotary member relative to a driving-side rotary member to a predetermined phase (locked phase), the restricting mechanism being constituted of a restricting recess formed in the driven-side rotary member and a restricting member provided in the driving-side rotary member and projectable/retractable into/from the restricting recess.

For instance, a restricting mechanism is known from PTL 1 which consists of an engaging pin 91 ("a restricting member") and an engaging groove 28 ("a restricting recess"). With this arrangement, it is possible to first restrict the relative rotational phase of the driven-side rotary member relative to the driving-side rotary member to a predetermined range and then to allow the locking mechanism to be actuated. Hence, there is provided the advantage of the locked state being realized more easily.

Further, the valve timing control apparatus disclosed in PTL 1 adopts the arrangement wherein an amount of fluid is discharged from an advance angle chamber and a retard angle chamber when the relative rotational phase is not the locked phase at the time of engine start. This arrangement is provided for realizing the locked state when and while the driven-side rotary member is rendered positively rotatable relative to the driving-side rotary member immediately after engine start.

CITATION LIST

Patent Literature

PTL 1: Japanese Patent No. 3918971

SUMMARY OF INVENTION

Technical Problem

However, with the valve timing control apparatus disclosed in Patent Document 1, in order to discharge fluid from the advance angle chamber and the retard angle chamber immediately after engine start, there is provided a switching valve 110 dedicated to this purpose. Hence, there is the possibility of inviting deterioration of the mountability and cost increase of the valve timing control apparatus. Further, if the locked state is to be realized at the time of engine start, there is the possibility of speedy shift to the driving condition becoming impossible. For this reason, it is desired that the locked state can be realized prior to engine stop. Moreover, if such locking mechanism for locking with discharge of fluid is implemented at the time of engine stop, while the fluid is discharged, the rotational speeds of the driven-side rotary member and the driving-side rotary member are reduced sharply, so that the locking may not be effected in a reliable manner.

In view of the above-described state of the art, an object of the present invention is to provide a valve timing control apparatus and a valve timing control mechanism that can realize the locked state speedily prior to engine stop through controlling a restricting mechanism and a locking mechanism during engine operation and that can dispense with a switching valve dedicated to controlling of the restricting mechanism and the locking mechanism.

Solution to Problem

According to a first characterizing feature of a valve timing control apparatus relating to the present invention, the valve timing control apparatus comprises:

a driving-side rotary member rotatable in synchronism with a crankshaft of an internal combustion engine;

a driven-side rotary member disposed coaxial with the driving-side rotary member and rotatable in synchronism with a valve opening/closing cam shaft of the internal combustion engine;

a fluid pressure chamber formed by the driving-side rotary member and the driven-side rotary member;

a partitioning portion provided in at least one of the driving-side rotary member and the driven-side rotary member for partitioning the fluid pressure chamber into an advance angle chamber and a retard angle chamber;

a restricting member provided in at least one of the driving-side rotary member and the driven-side rotary member and projectable and retractable relative to the other of the driving-side rotary member and the driven-side rotary member;

a restricting recess formed in the other rotary member and restricting a relative rotational phase of the driven-side rotary member relative to the driving-side rotary member to a range from one of a most advanced angle phase and a most retarded angle phase to a predetermined phase in association with projection of the restricting member therein;

a locking member disposed in the one rotary member having the restricting member, the locking member being projectable and retractable relative to the other rotary member;

a locking recess formed in the other rotary member and locking the relative rotational phase of the driven-side rotary member relative to the driving-side rotary member to the predetermined phase in association with projection of the locking member therein;

a communication passage formed between the restricting member and the locking member; and an urging passage for feeding fluid for projecting the restricting member into the restricting recess;

wherein the valve timing control apparatus is switchable into a first state for releasing the locking by the locking member and the restriction by the restricting member with feeding of the fluid into the communication passage, a second state for restricting the restricting member and releasing the locking by the locking member with non-feeding of the fluid to the communication passage and feeding of the fluid to the urging passage and a third state for restricting the restricting member and locking the locking member with feeding of the fluid neither to the communication passage nor to the urging passage.

With the above-described characterizing feature, depending on the presence/absence of feeding of fluid to the communication passage and presence/absence of feeding of fluid to the urging passage, there can be selectively provided the first state, the second state and the third state. For instance, if the feeding of fluid to the communication passage and the urging passage are effected through switching over between an advance angle control and a retard angle control, the switching valve dedicated to controlling of the restricting mechanism and the locking mechanism becomes unnecessary. So that, there can be provided a valve timing control apparatus favorable in the respects of mountability and cost.

Further, with the above-described characterizing feature, with feeding of fluid to the urging passage, it is possible to cause the restricting member to project into the restricting recess speedily. Therefore, it becomes easy to realize the second state or realize the third state eventually, by causing the restricting member to project into the restricting recess at a planned timing. As a result, speedy engine start is made possible.

According to a second characterizing feature of the present invention, the communication passage receives the feeding of fluid in association with establishment of communication thereof with one of the advance angle chamber and the retard angle chamber, and the urging passage receives the feeding of fluid in association with establishment of communication thereof with the other of the advance angle chamber and the retard angle chamber.

In the following discussion, it is assumed for the sake of this discussion that the communication passage receives the fluid feeding in association with establishment of communication thereof with the advance angle chamber and the urging passage receives the fluid feeding in association with establishment of communication thereof with the retard angle chamber. In this case, according to the above-described characterizing feature, if the retard angle control is effected under the first state for releasing locking by the locking member and releasing the restriction by the restricting member, the state is shifted to the second state for restricting the restricting member and releasing the locking by the locking member. In this, by the urging passage, the restricting member can be caused to project into the restricting recess in a speedy manner.

And, if the advance/retard angle control is effected to place the locking member to the predetermined phase with maintaining the second state, the state can be shifted now to the third state for restricting the restricting member and locking the locking member. Namely, with appropriate execution of the advance/retard angle control, the third state can be realized. Therefore, even in the event of failure to shift to the third state, the shifting control to the third state can be effected in repetition before engine stop; hence, the third state can be realized reliably.

According to a third characterizing feature of the present invention, the valve timing control apparatus further comprises:

a restriction releasing passage communicated with the one of the advance angle chamber and the retard angle chamber and feeding fluid for releasing the restriction by the restricting member; and a lock releasing passage communicated with the other of the advance angle chamber and the retard angle chamber and feeding fluid for releasing the locking by the locking member.

With the above-described characterizing feature, the restriction releasing passage is communicated with the advance angle chamber to receive feeding of fluid and the lock releasing passage is communicated with the retard angle chamber to receive feeding of fluid. Therefore, if the retard angle control is effected under the third state, fluid is fed to the lock releasing passage, so that the state is shifted to the second state. Next, if the advance angle control is effected under the second state, fluid is fed not only to the restriction releasing passage, but also to the communication passage, so that the state is shifted to the first state. Namely, in the case of shifting to the first state at the time of engine start too, the switching valve dedicated to controlling of the restricting mechanism and the locking mechanism becomes unnecessary. And, even in the event of failure in shifting, the first state can be realized reliably with repeated execution of the control.

According to a fourth characterizing feature of the present invention, the restriction releasing passage includes a restricting-time communication passage which is communicated with the one of the advance angle chamber and the retard angle chamber so as to feed fluid for releasing restriction by the restricting member when the restricting member projects into the restricting recess and a releasing-time communication passage which is communicated with the one of the advance angle chamber and the retard angle chamber so as to feed fluid for releasing restriction by the restricting member when the restricting member is retracted from the restricting recess.

With the above-described characterizing feature, the releasing-time communication passage for feeding fluid for releasing the restriction when the restricting member is retracted from the restricting recess is provided separately from the restricting-time communication passage for feeding fluid for releasing the restriction when the restricting member projects into the restricting recess. Therefore, with selection of which of the communication passages the releasing fluid is to be fed, there is provided greater variety in the control, so that the controllability can be improved.

According to a fifth characterizing feature of the present invention, the restricting-time communication passage is non-communicated with the one of the advance angle chamber and the retard angle chamber when the driving-side rotary member and the driven-side rotary member are present within a predetermined phase displaced toward one of the most advanced angle phase and the most retarded angle phase from the predetermined phase.

With the above-described characterizing feature, when the restricting member is located within a predetermined range on the predetermined phase side of the restricting recess, the restricting member is not retracted from the restricting recess. Therefore, during the shifting control from the second state to the third state in the vicinity of the predetermined phase, inadvertent release of the restriction by the restricting member will not occur. So that, the shifting to the third state can be effected even more reliably.

According to a sixth characterizing feature of the present invention, the passage feeding fluid to the other of the advance angle chamber and the retard angle chamber or the urging passage has a minimum cross section area larger than a minimum cross section area of the passage feeding fluid to the one of the advance angle chamber and the retard angle chamber.

With the above-described characterizing feature, when fluid is fed to the communication passage by the advance angle control for causing the restricting member to be retracted from the restricting recess, the fluid can be smoothly discharged from the urging passage via the retard angle chamber. Therefore, there will not occur the phenomenon that retraction of the restricting member from the restricting recess becomes difficult due to the residual pressure of the fluid fed from the urging passage, so that the shifting from the second state to the third state can be effected speedily.

According to a characterizing feature of a valve timing control mechanism relating to the present invention, the mechanism comprises:

the valve timing control apparatus having one of the first through sixth characterizing features described above;

a pump for feeding fluid to the valve timing control apparatus;

an advance/retard angle control valve for switching over which of the advance angle chamber and the retard angle chamber the fluid is to be fed; and a check valve disposed between the pump and the advance/retard angle control valve for checking flow of fluid to the pump.

When fluid is fed to the restricting-time communication passage by the advance angle control so as to cause the restricting member to be retracted from the restricting recess, normally the rise of fluid pressure in the advance angle chamber is affected by cam torque, thus experiencing variation. In this, if the variation lower limit of the fluid pressure in the advance angle chamber becomes lower than the fluid pressure of the retard angle chamber, it may occur that the restricting member cannot be retracted smoothly from the restricting recess due to the fluid pressure provided from the urging passage. With the above-described characterizing feature, such variation of fluid pressure can be restricted by the provision of the check valve. Hence, the variation lower limit of the fluid pressure of the advance angle chamber can be raised, so that the shifting from the second state to the third state may proceed even more speedily.

According to a characterizing feature of a valve timing control mechanism relating to the present invention, the mechanism comprises:

the valve timing control apparatus having one of the second through fifth characterizing features described above; and an advance/retard angle control valve for switching over which of the advance angle chamber and the retard angle chamber the fluid is to be fed;

wherein the passage between the advance/retard angle control valve and the other of the advance angle chamber and the retard angle chamber has a minimum cross section area larger than a minimum cross section area of the passage between the advance/retard angle control valve and the one of the advance angle chamber and the retard angle chamber.

With the above-described characterizing feature, when fluid is fed to the communication passage by the advance angle control for causing the restricting member to be retracted from the restricting recess, the fluid can be discharged smoothly from the urging passage via the retard angle chamber. Therefore, there will not occur the phenomenon that retraction of the restricting member from the restricting recess becomes difficult due to the residual pressure of the fluid fed from the urging passage, so that the shifting from the second state to the third state can be effected speedily.

DESCRIPTION OF EMBODIMENTS

Figure 1:
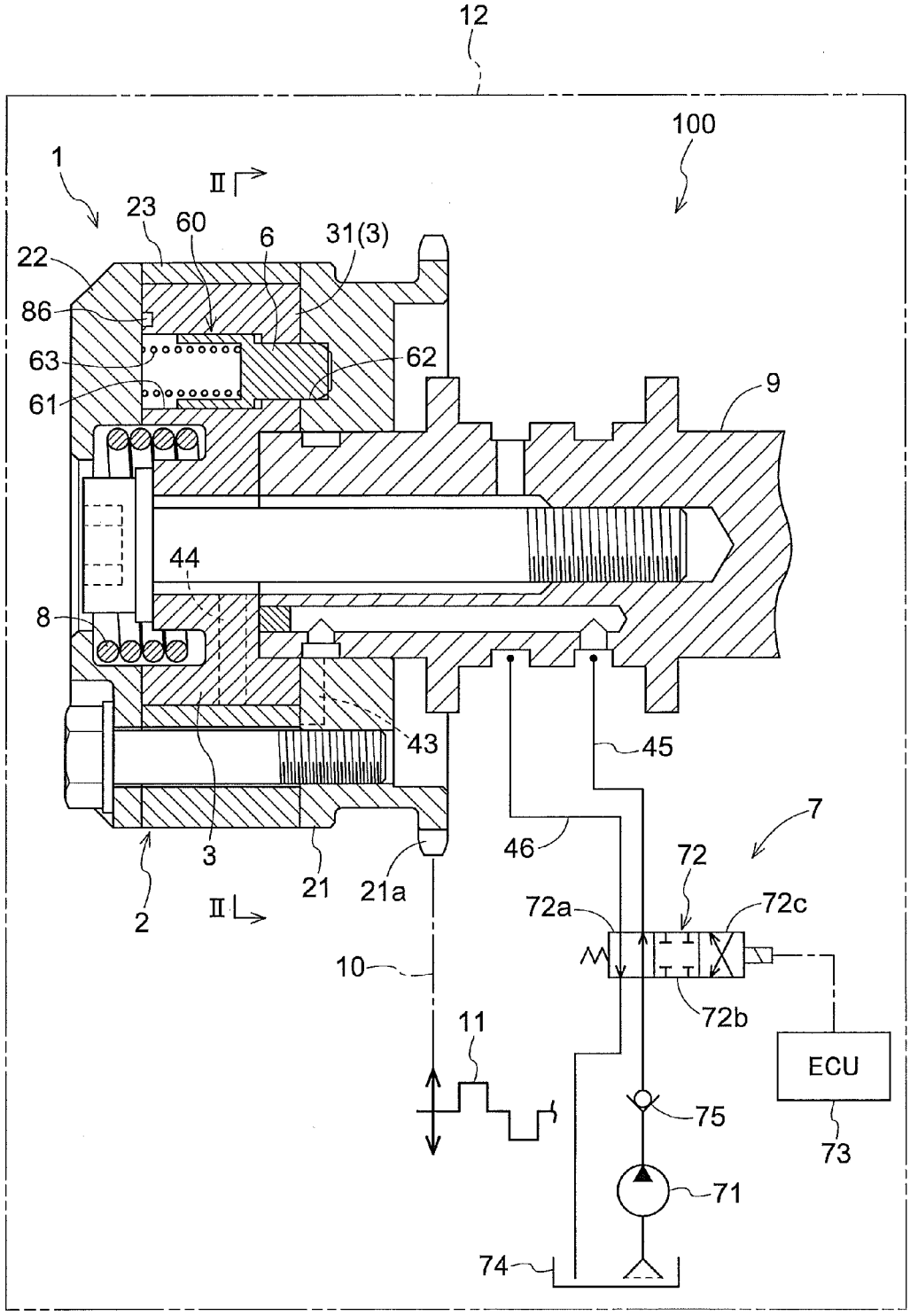
[FIG. 1] is a section view showing a general construction of a valve timing control apparatus.

Next, an embodiment of the present invention will be described with reference to FIGS. 1 through 13. Firstly, with reference to FIG. 1 and FIG. 2, the general construction of a valve timing control apparatus 1 will be explained.

(General Construction)

The valve timing control apparatus 1 includes an outer rotor 2 as a "driving-side rotary member" rotatable in synchronism with a crankshaft 11 of an engine 12 and an inner rotor 3 disposed coaxial relative to the outer rotor 2 and acting as a "driven-side rotary member" rotatable in synchronism with a cam shaft 9.

The outer rotor 2 includes a rear plate 21 attached to the side to be connected with the cam shaft 9, a front plate 22 attached to the side opposite the cam shaft 9 connected side, and a housing 23 sandwiched between the rear plate 21 and the front plate 22. The inner rotor 3 mounted within the outer rotor 2 is assembled integrally with the leading end of the cam shaft 9 and is capable of relative rotation relative to the outer rotor 2 within a predetermined range.

Figure 2:
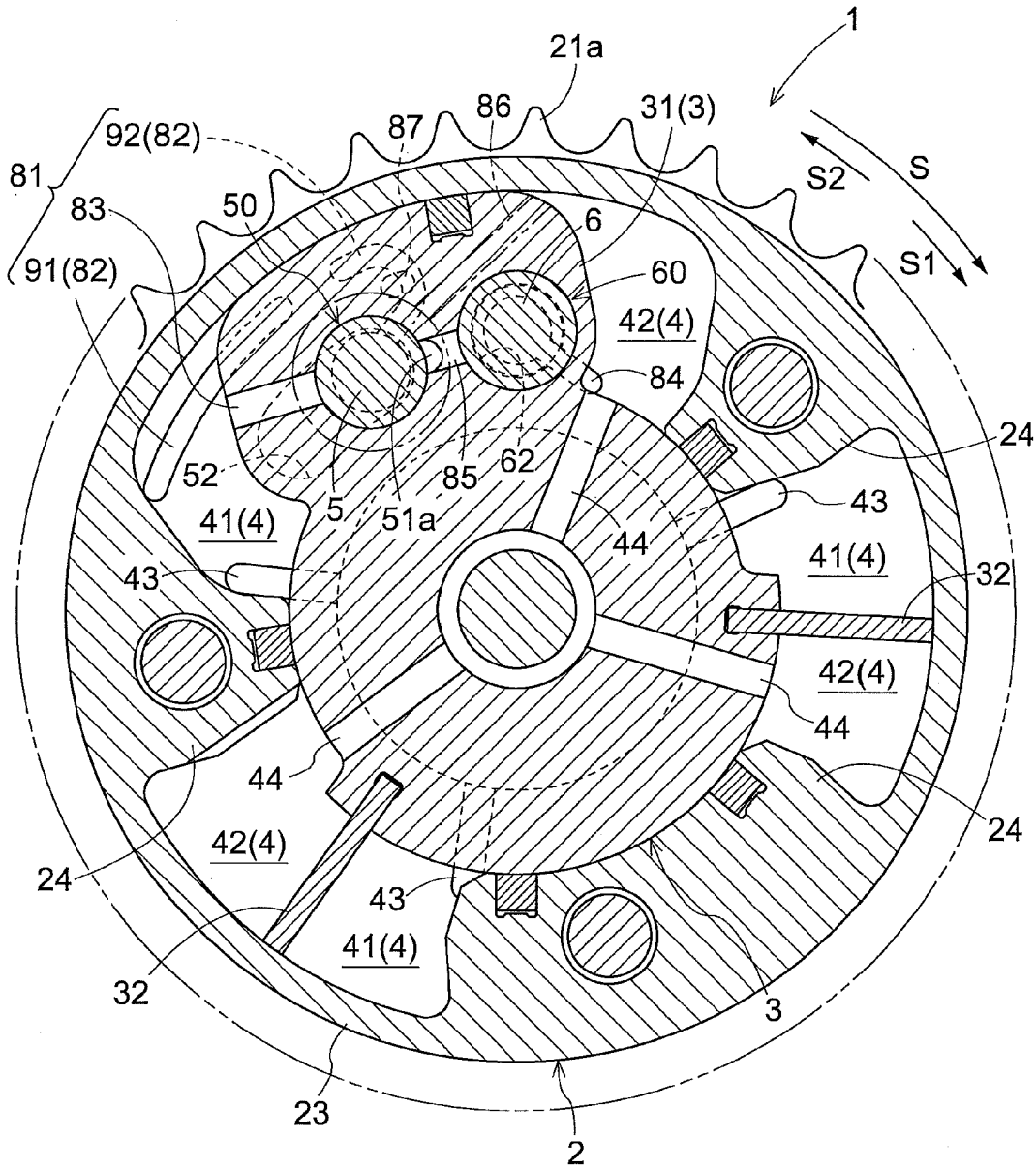
[FIG. 2] is a section along II-II in FIG. 1.
Figure 3:
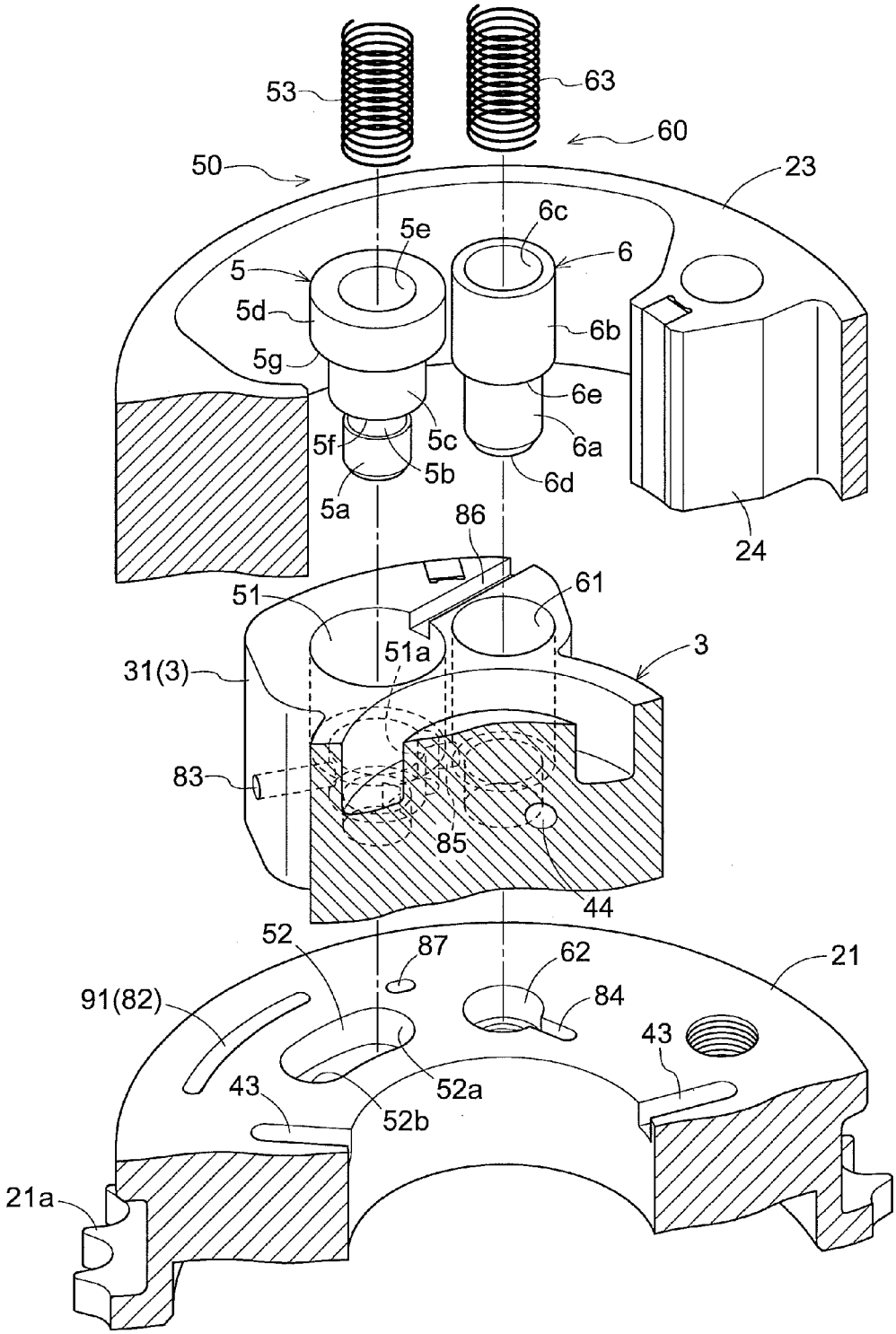
[FIG. 3] is an exploded view showing the arrangements of a restricting mechanism and a locking mechanism.
Figure 4:
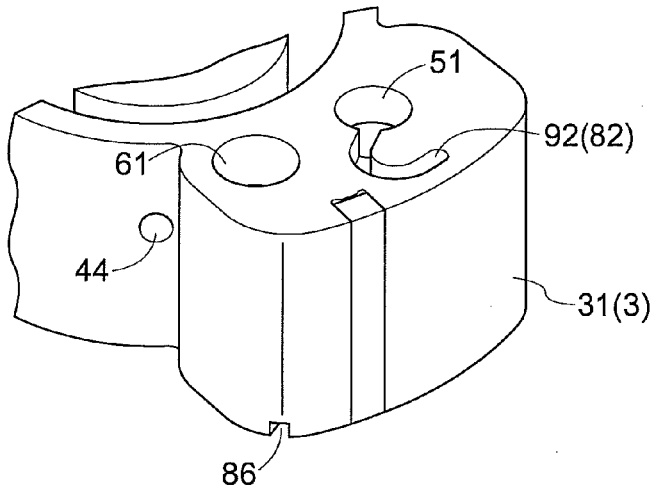
[FIG. 4] is a perspective view of an inner rotor.

When the crankshaft is driven to rotate, its rotational drive force is transmitted via a force transmission member 10 to a sprocket portion 21*a* of the rear plate 21, whereby the outer rotor 2 is driven to rotate in the direction S shown in FIG. 2. In association with this driven rotation of the outer rotor 2, the inner rotor 3 is driven to rotate in the direction S and the cam shaft 9 rotates.

The housing 23 of the outer rotor 2 forms a plurality of projecting portions 24 projecting radially inward along the S direction. These projecting portions 24 and the inner rotor 3 together form fluid pressure chambers 4. In the instant embodiment, the fluid pressure chambers 4 are provided at three locations. However, the invention is not limited thereto.

Each fluid pressure chamber 4 is partitioned into two portions, i.e. an advance angle chamber 41 and a retard angle chamber 42, by a partitioning portion 31 forming a part of the inner rotor 3 or by a vane 32 attached to the inner rotor 3. A restricting member accommodating portion 51 and a locking member accommodating portion 61 defined in the partitioning portion 31 accommodates respectively a restricting member 5 and a locking member 6, thus constituting a restricting mechanism 50 and a locking mechanism 60, respectively. These constructions will be detailed later.

An advance angle passage 43 defined in the cam shaft 9 and the rear plate 21 is communicated to the advance angle chamber 41. Similarly, a retard angle passage 44 defined in the cam shaft 9 and the inner rotor 3 is communicated to the retard angle chamber 42. Between the valve timing control apparatus 1 and a fluid feeding/discharging mechanism 7, there are formed an advance angle connection passage 45 connected to the advance angle passage 43 and a retard angle connection passage 46 connected to the retard angle passage 44. These passages, i.e. the advance angle connection passage 45 and the retard angle connection passage 46 are defined in e.g. an unillustrated cylinder head including the cam shaft 9 and the fluid feeding/discharging mechanism 7. Here, the mechanism including the valve timing control apparatus 1 and the fluid feeding/discharging mechanism 7 will be referred to as "a valve timing control mechanism 100".

The advance angle passage 43 and the retard angle passage 44 feed or discharge fluid into/from the advance angle chamber 41 and the retard angle chamber 42 via the fluid feeding/discharging mechanism 7, thereby to apply a fluid pressure to the partitioning portion 31 or the vane 32. In this way, the relative rotational phase of the inner rotor 3 relative to the outer rotor 2 is displaced in the angle advancing direction S1 or the angle retarding direction S2, or is maintained at a desired phase. Incidentally, as the fluid, engine oil is employed generally.

The predetermined range within which the outer rotor 2 and the inner rotor 3 are rotatable relative to each other corresponds to the range in which the partitioning portion 31 or the vane 32 can be displaced within the fluid pressure chamber 4. The most advanced angle phase is the phase where the capacity of the advance angle chamber 41 is at its maximum. The most retarded angle phase is the phase where the capacity of the retard angle chamber 42 is at its maximum. Namely, the relative rotational phase is displaceable between the most advanced angle phase and the most retarded angle phase.

A torsion spring 8 is provided between and across the inner rotor 3 and the front plate 22. Hence, the inner rotor 3 and the outer rotor 2 are urged by the torsion spring 8 such that the relative rotational phase thereof may be displaced along the angle advancing direction S1.

Next, the construction of the fluid feeding/discharging mechanism 7 will be explained. The fluid feeding/discharging mechanism 7 includes a pump 71 driven by the engine for feeding fluid, an advance/retard angle control valve 72 for controlling feeding/discharging of fluid relative to the advance angle chamber 43 and the retard angle chamber 44, a reservoir portion 74 for reserving an amount of fluid and a check valve 75 disposed between the pump 71 and the advance/retard angle control valve 72. This check valve 75 is configured to check (prevent) flow of fluid from the side of the advance/retard angle control valve 72 to the side of the pump 71.

The advance/retard angle control valve 72 is operated under control of an ECU (engine control unit) 73. The advance/retard angle control valve 72 includes a first position 72*a* for effecting an advance angle control with allowing feeding of fluid to the advance angle passage 43 and allowing discharging of fluid from the retard angle passage 44, a second position 72*b* for effecting a phase maintaining control with inhibiting feeding/discharging of fluid to/from the advance angle passage 43 and the retard angle passage 44, and a third position 72*c* for effecting a retard angle control with allowing discharging of fluid from the advance angle passage 43 and allowing feeding of fluid to the advance angle passage 44. The advance/retard angle control valve 72 employed in the instant embodiment is configured to effect the advance angle control at the first position 72*a* when no control signal from the ECU 73 is present.

(Restricting Mechanism)

With reference to FIG. 3, FIG. 4 and FIGS. 6-13, there will be explained the construction of the restricting mechanism 50 for restricting the relative rotational phase to the range from the most retarded angle phase to an intermediate locked phase (this range will be referred to as "a restriction range R" hereinafter). Incidentally, the term "intermediate locked phase" refers to a relative rotational phase which locking is effected by the locking mechanism 60 to be detailed later.

The restricting mechanism 50 includes the restricting member 5 which has a generally stepped cylindrical shape, the restricting member accommodating portion 51 for accommodating the restricting member 5, and a restricting recess 52 in the form of an elongate slot defined in the surface of the rear plate 21 for allowing projection of the restricting member 5 therein.

More particularly, the restricting member 5 has a shape formed of four cylinders of differing diameters stacked one on another. These four stages of cylinders will be referred to respectively as a first step portion 5*a*, a second step portion 5*b*, a third step portion 5*c* and a fourth step portion 5*d*, in the order of recitation thereof from the side of the rear plate 21. The second step portion 2*b* is formed with a smaller diameter than the first step portion 5*a*. And, toward the side of the front plate 22 therefrom, the second step portion 5*b*, the third step portion 5*c* and the fourth step portion 5*d* are formed with progressively increased diameters.

The first step portion 5*a* is configured to be projectable into the restricting recess 52. And, when the first step portion 5*a* projects into the restricting recess 52, as will be described later, the relative rotational phase is restricted within the restriction range R. The fourth step portion 5*d* defines a cylindrical recess 5*e* which accommodates a spring 53 therein.

The restricting member accommodating portion 51 is formed in the inner rotor 3 along the direction of the rotational axis (this will be referred to as "the rotational axis" hereinafter) of the cam shaft 9 and extends through the inner rotor 3 from the front plate 22 side to the rear plate 21 side. The restricting member accommodating portion 51 has a shape which is formed of e.g. three cylindrical spaces with differing diameters stacked one on another, so that the restricting member 5 is movable therein. Of the inner peripheral face of the restricting member accommodating portion 51, a portion thereof connected to a communication passage 85 to be described later defines a vertical groove portion 51*a* having a semi-circular cross section. Via this vertical groove portion 51*a* and the communication passage 85, communication is established between a first fluid chamber 54, a second fluid chamber 55 and a fourth fluid chamber 65 to be described later.

The restricting recess 52 has an arcuate shape centering about the rotational axis and its position in the radial direction is made slightly different from a locking recess 62 to be described later. The restricting recess 52 forms a first end portion 52*a* as the advance angle side end and a second end portion 52*b* as the retard angle side end. When the restricting member 5 is placed in contact with the first end portion 52*a*, the relative rotational phase is set to an intermediate locked phase. When the restricting member 5 is placed in contact with the second end portion 52*b*, the relative rotational phase is set to the most retarded angle phase. That is, the restricting recess 52 corresponds to the restriction range R.

The restricting member 5 is accommodated in the restricting member accommodating portion 51 and is constantly urged toward the rear plate 21 side by a spring 53. When the first step portion 5*a* of the restricting member 5 projects into the restricting recess 52, the relative rotational phase is restricted within the restriction range R, thus realizing a "restricted state". When the first step portion 5*a* is retracted away from the restricting recess 52 against the urging force of the spring 53, the restricted state is released, thus realizing a "restriction released state".

When the restricting member 5 is accommodated in the restricting member accommodating portion 51, the restricting member 5 and the restricting member accommodating portion 51 together form the first fluid chamber 54 and the second fluid chamber 55. The first fluid chamber 54 is formed on the outer side of the second step portion 5*b* of the restricting member 5 and fluid fed into the first fluid chamber 54 will apply its fluid pressure to a first pressure receiving face 5*f* as the bottom face of the third step portion 5*c* of the restricting member 5, thus causing the restricting member 5 to be retracted from the restricting recess 52. The second fluid chamber 55 is formed on the outer side of the third step portion 5*c* of the restricting member 5 and fluid fed into the second fluid chamber 55 will apply a fluid pressure to a second pressure receiving face 5*g* which constitutes the bottom face of the fourth step portion 5*d* of the restricting member 5, thereby to cause the restricting member 5 to be retracted from the restricting recess 52. Incidentally, the first fluid chamber 54 and the second fluid chamber 55 are communicated to each other via the vertical groove portion 51*a*.

Further, when the restricting member 5 is accommodated in the restricting member accommodating portion 51, the restricting member 5 and the front plate 22 together form a back face fluid chamber 56. This back face fluid chamber 56 is a space integral with the recess 5*e* of the restricting member 5, so that when fluid is fed therein from an urging passage 86 to be described later, the fluid will urge the restricting member 5 toward the rear plate 21.

(Locking Mechanism)

Next, the construction of the locking mechanism 60 for locking the relative rotational phase to the intermediate locked phase will be described with reference to FIG. 3, FIG. 4 and FIGS. 6-13. The locking mechanism 60 includes a locking member 6 having a generally stepped cylindrical shape, a locking member accommodating portion 61 for accommodating the locking member 6 and a locking recess 62 in the form of a circular hole defined in the surface of the rear plate 21 for allowing projection of the locking member 6 therein.

The locking member 6 has a shape formed of two cylinders of differing diameters stacked one on the other. These two stages of cylinders will be referred to as a first step portion 6*a* and a second step portion 6*b*, in the order from the rear plate 21 side. The first step portion 6*a* is formed with a smaller diameter than the second step portion 6*b*.

The first step portion 6*a* is configured to be projectable into the locking recess 62. And, when the first step portion 6*a* projects into the locking recess 62, the relative rotational phase is locked to the intermediate locked phase. The second step portion 6*b* defines a cylindrical recess 6*c* which accommodates a spring 63 therein.

The locking member accommodating portion 61 is formed in the inner rotor 3 along the direction of the rotational axis and extends through the inner rotor 3 from the front plate 22 side toward the rear plate 21 side. The locking member accommodating portion 61 has a shape which is formed of two cylindrical spaces with differing diameters stacked one on the other, so that the locking member 6 is movable therein.

The locking member 6 is accommodated in the locking member accommodating portion 61 and is constantly urged toward the rear plate 21 side by a spring 63. When the first step portion 6*a* of the locking member 61 projects into the locking recess 62, the relative rotational phase is locked to the intermediate locked state, thus realizing a "locked state". When the first step portion 6*a* is retracted away from the locking recess 62 against the urging force of the spring 63, the locked state is released, thus realizing a "locking released state".

When the locking member 6 is caused to project into the locking recess 62, the locking member 6 and the locking recess 62 together form the third fluid chamber 64. This third fluid chamber 64 is formed on the rear plate 21 side of the locking member 6 and fluid fed into the third fluid chamber 64 applies a fluid pressure to the first pressure receiving face 6*d* as the bottom face of the first step portion 6*a* of the locking member 6, thus causing the locking member 6 to be retracted away from the locking recess 62.

When the locking member 6 is accommodated in the locking member accommodating portion 61, the locking member 6 and the locking member accommodating portion 61 together form the fourth fluid chamber 65. The fourth fluid chamber 65 is formed on the outer side of the first step portion 6*a* of the locking member 6 and fluid fed into the fourth fluid chamber 65 will apply its fluid pressure to a second pressure receiving face 6*e* as the bottom face of the second step portion 6*b* of the locking member 6, thus maintaining the locking released state in which the locking member 6 is retracted away from the locking recess 62.

Next, the constructions of the respective passages will be explained with reference to FIG. 3, FIG. 4 and FIGS. 6-13.

(Restriction Releasing Passage)

The restriction releasing passage 81 for realizing the restriction released state includes a restricting-time communication passage 82 and a releasing-time communication passage 83. The restricting-time communication passage 82 consists of a rear plate passage 91 and a U-shaped passage 92 to be described later and is provided as a passage for feeding fluid from the advance angle chamber 41 to the first fluid chamber 54 for releasing the restricted state. Further, the releasing-time communication passage 83 is provided as a passage for feeding fluid from the advance angle chamber 41 to the first fluid chamber 54 for maintaining the restriction released state when the restricting member 5 is retracted away from the restricting recess 52.

The first fluid chamber 54 is communicated to the second fluid chamber 55 via the vertical groove portion 51*a* and is communicated to the fourth fluid chamber 65 via the vertical groove portion 51*a* and the communication passage 85 to be described later. Accordingly, fluid fed into the first fluid chamber 54 from the restriction releasing passage 81, namely, from either one of the restricting-time communication passage 82 and the releasing-time communication passage 83, will be fed also into the second fluid chamber 55 and the fourth fluid chamber 65.

The rear plate passage 91 is a passage in the form of an arcuate groove defined in the inner rotor 3 side face of the rear plate 21 and is communicated to the advance angle chamber 41. Further, the U-shaped passage 92 is a passage in the form of U-shaped groove defined in the rear plate 21 side face of the inner rotor 3 and is communicated to the first fluid chamber 54. The rear plate passage 91 is configured to be communicated to the U-shaped passage 92 only when the restricting member 5 is present within a predetermined retard angle side range (this will be referred to as the "restriction releasable range T" hereinafter) within the restriction range R. Incidentally, the presence of the restricting member 5 within the range of the restriction releasable range T means that the first step portion 5*a* along its entire range is present within the restriction releasable range T.

That is, if fluid is fed into the advance angle chamber 41 when the restricting member 5 is present within the restriction releasable range T and the rear plate passage 91 and the U-shaped passage 92 are communicated to each other, the restricting-time communication passage 82 feeds fluid to the first fluid chamber 54 and the second fluid chamber 55, thereby to apply the fluid pressure to the first pressure receiving face 5*f* and the second pressure receiving face 5*g*, thereby to release the restriction by the restricting member 5.

The releasing-time communication passage 83 is a passage in the form of a tube defined inside the inner rotor 3 and is communicated to the advance angle chamber 41. When the restricting member 5 projects into the restricting recess 52, thus realizing the restricted state, communication between the releasing-time communication passage 83 and the first fluid chamber 54 is blocked by the lateral wall of the third step portion 5*c* of the restricting member 5. On the other hand, when the restricting member 5 is retracted from the restricting recess 52 thus realizing the restriction released state, communication is established between the releasing-time communication passage 83 and the first fluid chamber 54, so that the restriction released state is maintained by the fluid fed from the advance angle chamber 41.

In case fluid is fed from the advance angle chamber 41 to the first fluid chamber 54, from which of the restricting-time communication passage 82 and the releasing-time communication passage 83 the fluid is to be fed into the first fluid chamber 54 will be selected, basically in accordance with the operation of the restricting member 5. Strictly, however, at the time of switchover between the restricting-time communication passage 82 and the releasing-time communication passage 83, fluid will be fed from both the restricting-time communication passage 82 and the releasing-time communication passage 83 into the first fluid chamber 54. This is for the following reason. If there occurs a situation wherein neither the restricting-time communication passage 82 nor the releasing-time communication passage 83 is communicated to the first fluid chamber 54 at the time of switchover between the restricting-time communication passage 82 and the releasing-time communication passage 83, the first fluid chamber 54 will be brought into a sealed condition temporarily, thus impairing smoothness of the operation of the restricting member 5.

(Drain Passage)

A drain passage 87 is a passage for speedily discharging the fluid present inside the first fluid chamber 54 and the second fluid chamber 55 which would act against the movement of the restricting member 5 when this restricting member 5 is to project into the restricting recess 52. The drain passage 87 is formed to extend through the rear plate 21 along the direction of rotational axis.

The drain passage 87 is communicated to the U-shaped passage 92 only when the restricting member 5 is present within a predetermined advance angle side range from the restriction releasable range T, so that the fluid present inside the first fluid chamber 54 and the second fluid chamber 55 will be discharged via the U-shaped passage 92 and the drain passage 87. When the restricting member 5 is present within the restriction releasable range T, no communication is established between the drain passage 87 and the U-shaped passage 92, thus preventing fluid, which has been fed from the advance angle chamber 41 while the rear plate passage 91 and the U-shaped passage 92 are communicated to each other, from being discharged directly into the drain passage 87.

(Lock Releasing Passage)

The lock releasing passage 84 is a passage in the form of a groove defined in the rear plate 21 and is communicated to the third fluid chamber 64. Under the locked state with the locking member 6 projecting into the locking recess 62, the lock releasing passage 84 is communicated to the retard angle chamber 42, so that fluid fed into the third fluid chamber 64 from the retard angle chamber 42 via the lock releasing passage 84 applies its fluid pressure to the first pressure receiving face 6*d* of the locking member 6, thereby to cause the locking member 6 to be retracted from the locking recess 62 to realize the locking released state.

(Communication Passage)

The communication passage 85 is a tubular passage formed inside the inner rotor 3 and communicates the vertical groove portion 51*a* of the restricting member accommodating portion 51 to the fourth fluid chamber 65. When fluid is fed into the first fluid chamber 54 from the restriction releasing passage 81, that is, from either the restricting-time communication passage 82 or the releasing-time communication passage 83, fluid present inside the first fluid chamber 54 is fed to the communication passage 85 via the vertical groove portion 51*a*. As a result, the fluid is fed into the fourth fluid chamber 65, so that the locking released state can be maintained.

(Urging Passage)

The urging passage 86 is a passage in the form of a groove defined in the front plate 22 side face of the inner rotor 3 and communicates the retard angle chamber 42 with the back face fluid chamber 56. Therefore, when fluid is fed into the retard angle chamber 42, the fluid is fed to the back face fluid chamber 56 via the urging passage 86, thus urging the restricting member 5 toward the rear plate 21, thus realizing the restricted state speedily. On the other hand, when fluid is fed into the advance angle chamber 41, the fluid in the back face fluid chamber 56 is discharged from the retard angle chamber 42 via the urging passage 86, so that the restriction released state can be realized speedily.

(Operations of Restricting Mechanism and Locking Mechanism)

Figure 5:
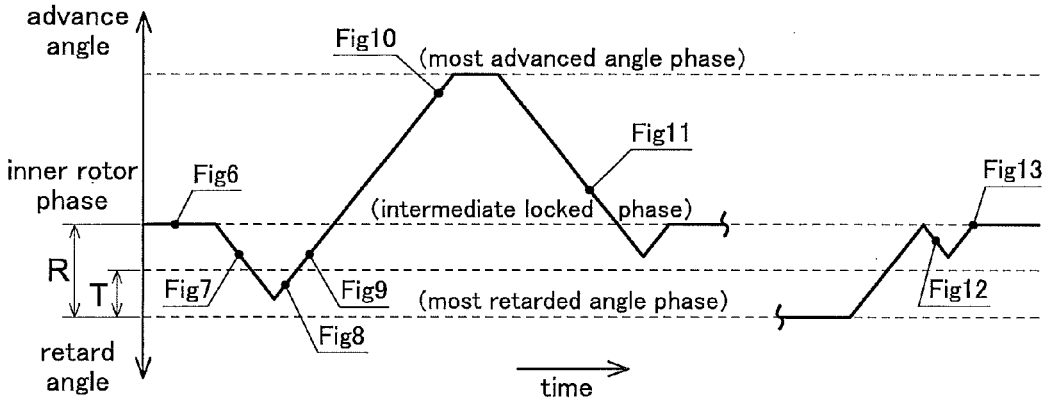
[FIG. 5] is a chart showing states of FIGS. 6-13.

FIG. 5 shows a flowchart illustrating one example of control scheme using the valve timing control apparatus 1, with the vertical axis indicating the relative rotational phase of the inner rotor 3 relative to the outer rotor 2. The relative rotational phase is locked at the intermediate locked phase at the time of engine start and engine stop. As described above, at the time of engine start, the locked state can be released by switching over to the advance angle control after displacement to the range within the restriction releasable range T. Whereas, the locked state can be realized by switching over to the advance angle control within a range in the restriction range R, not included in the restriction releasable range T. Next, the respective states plotted on the chart will be explained with reference to FIGS. 6-13.

(Operations at Time of Lock Releasing and Restriction Releasing)

The procedure for releasing the restricted state after releasing the locked state, that is, the procedure of shifting from the third state via the second state to the first state will be explained with reference to FIGS. 6-9.

Figure 6:
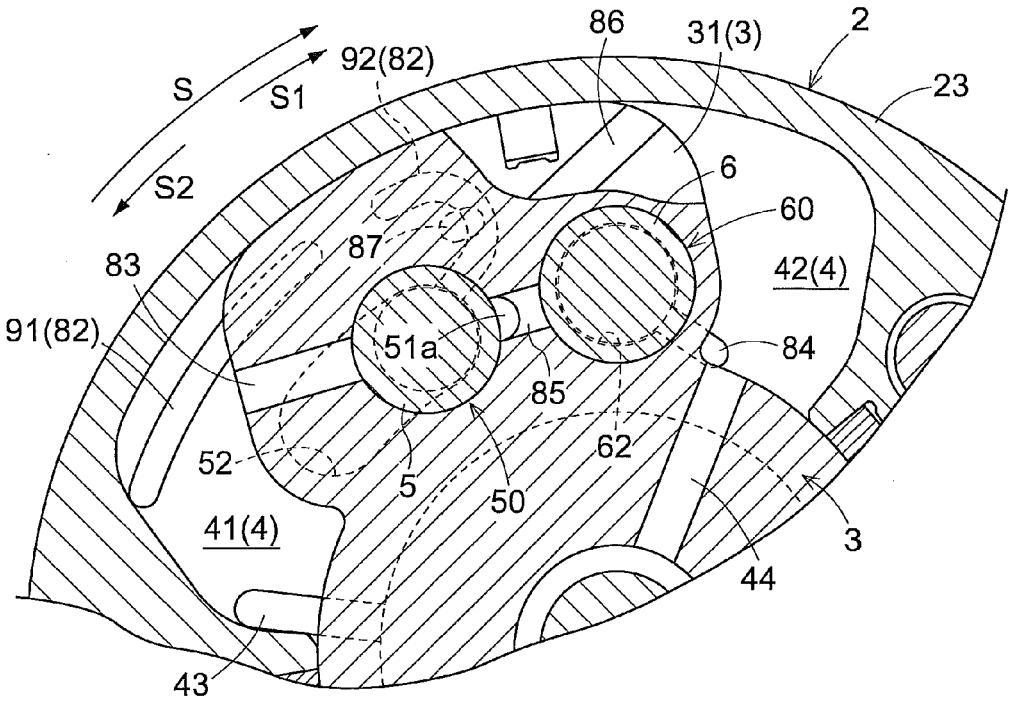
[FIG. 6] shows a third state, with (a) being a plan view, (b) being a section view.
Figure 6:
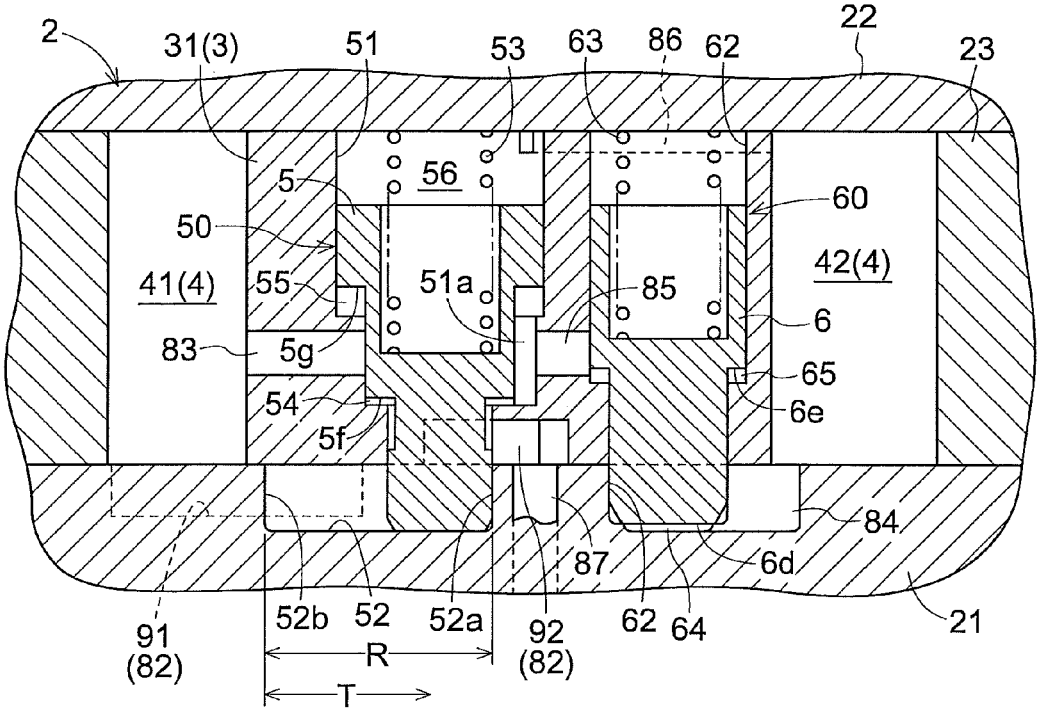

FIG. 6 shows the restricting mechanism 50 and the locking mechanism 60 under the locked states at the time of engine start and engine stop, that is, under the third state. At the time of engine start, the advance/retard angle control valve 72 is located at the first position 72*a*, so the advance angle control is effected. However, since the restricting member 5 is present outside the restriction releasable range T, no fluid is fed from the restricting-time communication passage 82 to the first fluid chamber 54. Further, since the releasing-time communication passage 83 too is not communicated to the first fluid chamber 54, no feed is fed to the first fluid chamber 54. Therefore, the locked state is maintained.

Figure 7:
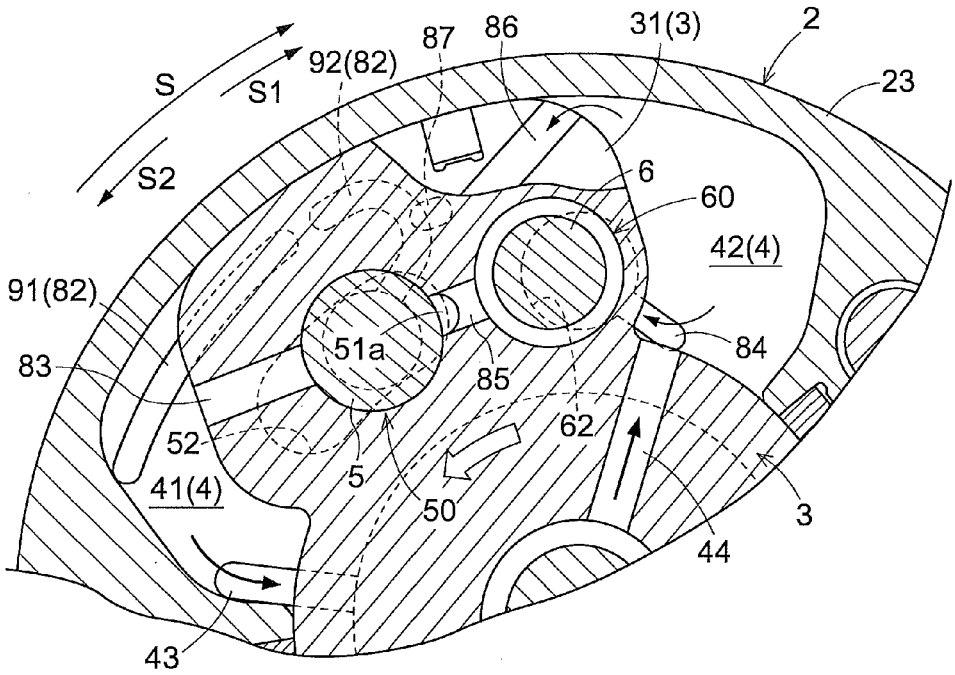
[FIG. 7] shows shifting from the third state to the second state, with (a) being a plan view, (b) being a section view.
Figure 7:
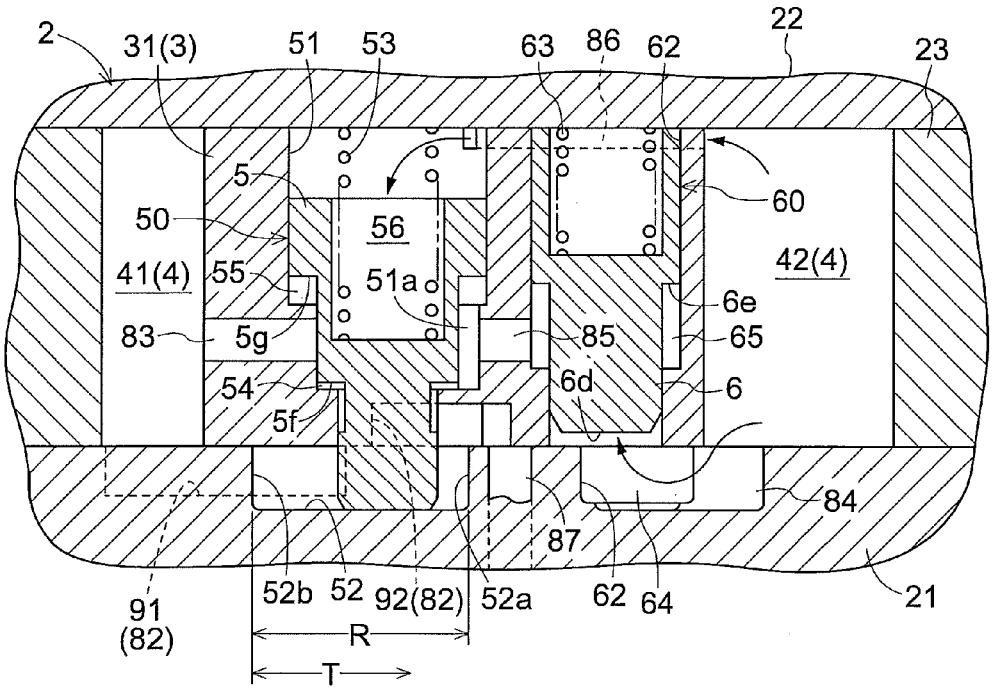

FIG. 7 shows a condition wherein the control has been switched over to the retard angle control after engine start in order to release the locked state, that is, to shift from the third state to the second state. In this time, fluid is fed from the retard angle chamber 42 to the third fluid chamber 64 via the lock releasing passage 84, thereby to apply its fluid pressure to the first pressure receiving face 6*d* of the locking member 6, so that the locking member 6 is retracted away from the locking recess 62, thus releasing the locked state. Upon release of the locked state, the restricting member 5 is moved in the retard angle direction.

Figure 8:
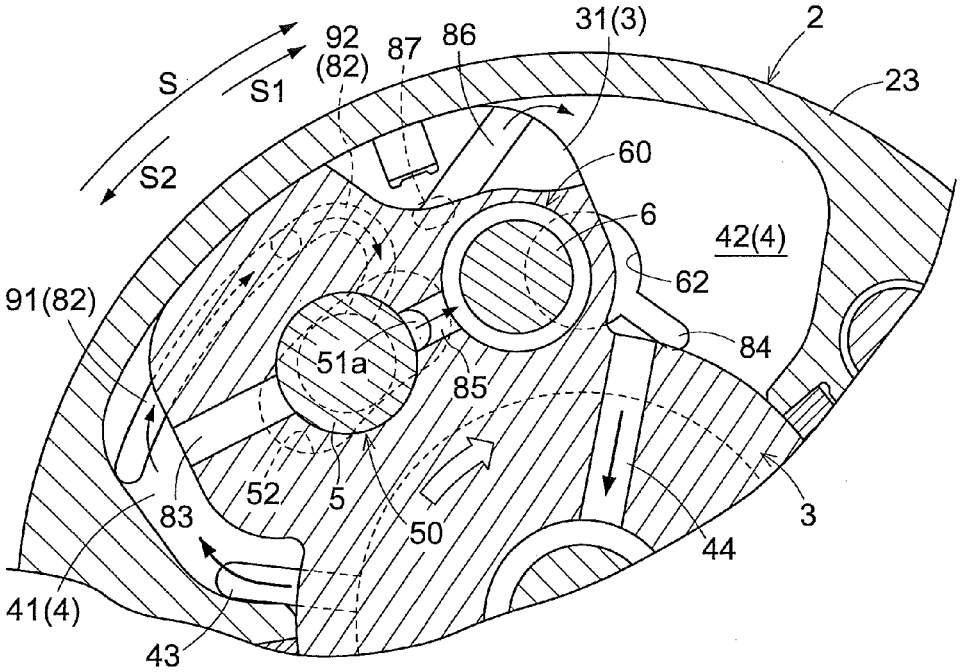
[FIG. 8] shows shifting from the second state to a first state, with (a) being a plan view, (b) being a section view.
Figure 8:
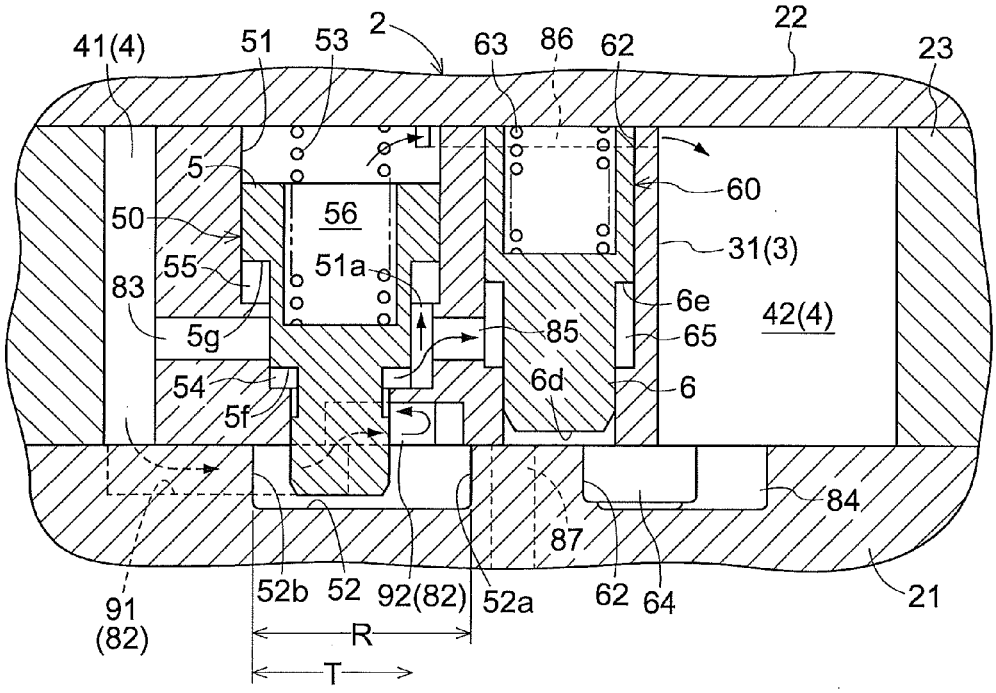

If an unillustrated phase sensor detects that the restricting member 5 has moved to a relative rotational phase within the restriction releasable range T, the ECU 73 switches the control over to the advance angle control, thus shifting from the second state to the first state. This condition is illustrated in FIG. 8. As the rear plate passage 91 and the U-shaped passage 92 are communicated to each other, fluid id fed from the restricting-time communication passage 82 to the first fluid chamber 54. Then, fluid pressure is applied to the first pressure receiving face 5*f* of the restricting member 5, whereby the restricting member 5 is retracted from the restricting recess 52, thus releasing the restricted state.

In this time, the fluid present inside the first fluid chamber 54 is fed also to the second fluid chamber 55 via the vertical groove portion 51*a*. Hence, the fluid pressure is applied also to the second pressure receiving face 5*g* of the restricting member 5 and also the fluid is discharged from the back face fluid chamber 56 via the urging passage 86. As a result, the restricting member 5 can be retracted from the restricting groove 52 speedily. Further, since the fluid inside the first fluid chamber 54 is fed also to the fourth fluid chamber 65 via the vertical groove portion 51a and the communication passage 85, the fluid pressure is applied also to the second pressure receiving face 6*e* of the locking member 6, thus maintaining the locking released state.

Preferably, the minimum cross section areas of the retard angle passage 44 and the urging passage 86 are respectively set larger than the minimum cross section area of the advance angle passage 43. This arrangement advantageously facilitates discharging of the fluid inside the back face fluid chamber 56 from the retard angle chamber 42 via the urging passage 86 in the course of shifting form the second state to the first state. That is, this arrangement serves to avoid the inconvenience of retraction of the restricting member 5 from the restricting recess 52 being made difficult due to the residual pressure of the fluid inside the back side fluid chamber 56, whereby the releasing of the restricted state can be realized even more speedily.

Further, in the instant embodiment, between the pump 71 and the advance/retard angle control valve 72, there is provided the check valve 75 for inhibiting the flow of fluid toward the pump 71. Therefore, at the time of advance angle control, it is possible to restrict variation of the fluid pressure in the advance angle chamber 41 due to the influence of cam torque. Hence, the variation lower limit value of the fluid pressure of the advance angle chamber 41 can be raised, so that the releasing of the restricted state can be realized even more speedily.

Figure 9:
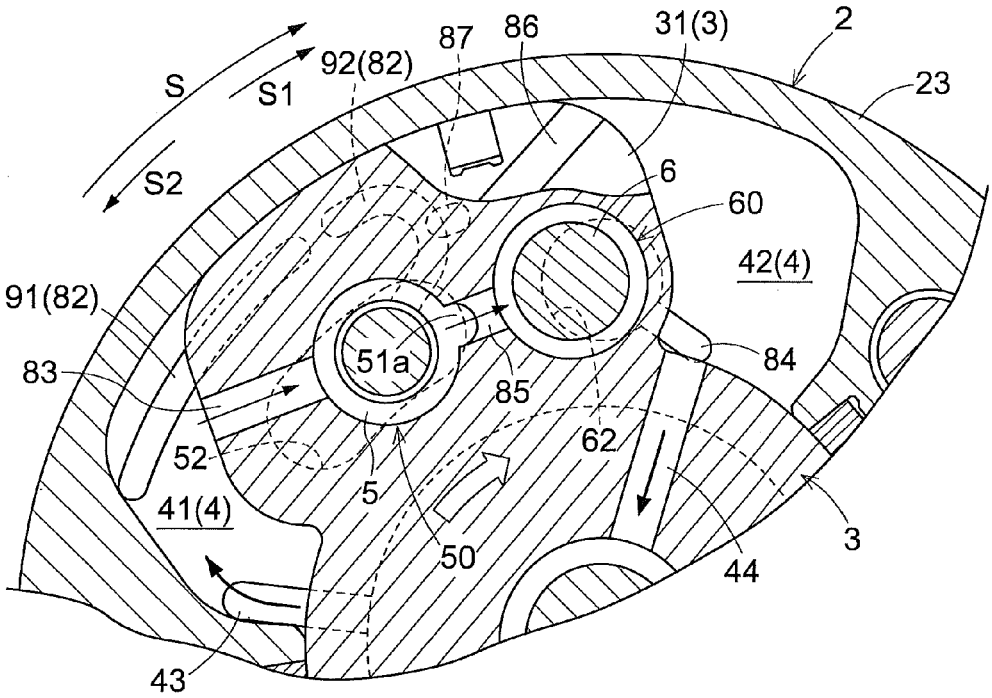
[FIG. 9] shows the first state, with (a) being a plan view, (b) being a section view.
Figure 9:
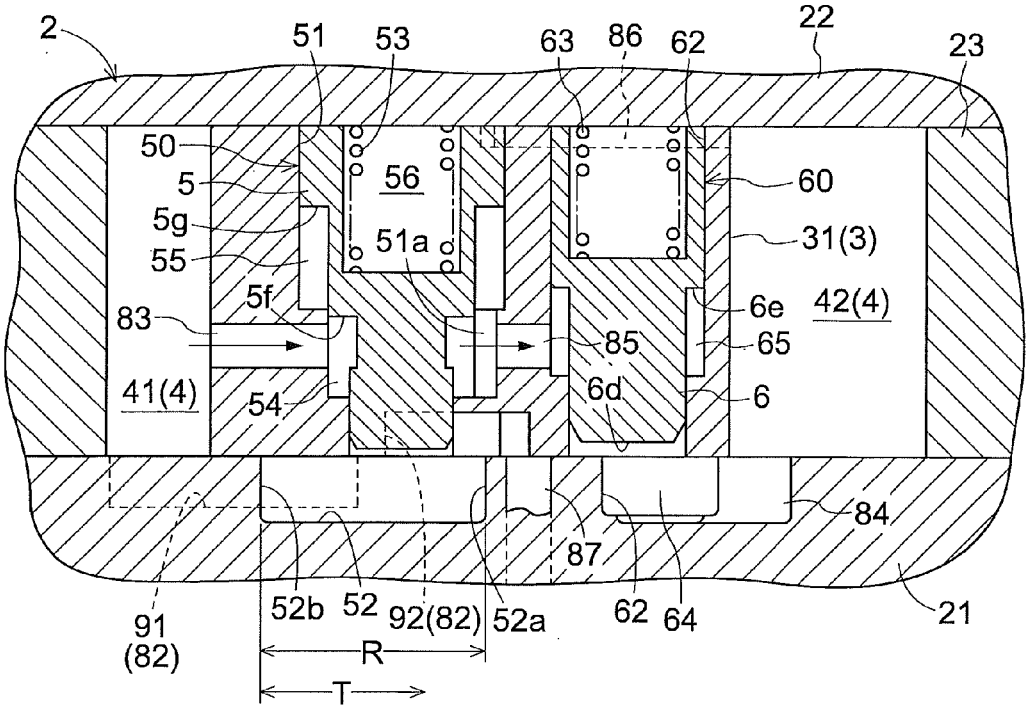

FIG. 9 shows a condition wherein the restriction released state and locking released state are maintained by the advance angle control. Namely, FIG. 9 shows the restricting mechanism 50 and the locking mechanism 60 under the first state. In this state, fluid of the advance angle chamber 41 is fed to the first fluid chamber 54 via the releasing-time communication passage 83. As the first fluid chamber 54 and the fourth fluid chamber 65 are communicated to each other via the vertical groove portion 51*a* and the communication passage 85, the fluid fed from the advance angle chamber 41 to the first fluid chamber 54 is fed also to the fourth fluid chamber 65. As a result, the restriction released state and the locking released state are maintained.

(Operations Under Normal Driving State)

Next, the operations under the normal driving state as the result of realization of the restriction released state and the locking released state, that is, realization of the first state, will be explained with reference to FIG. 10 and FIG. 11.

Figure 10:
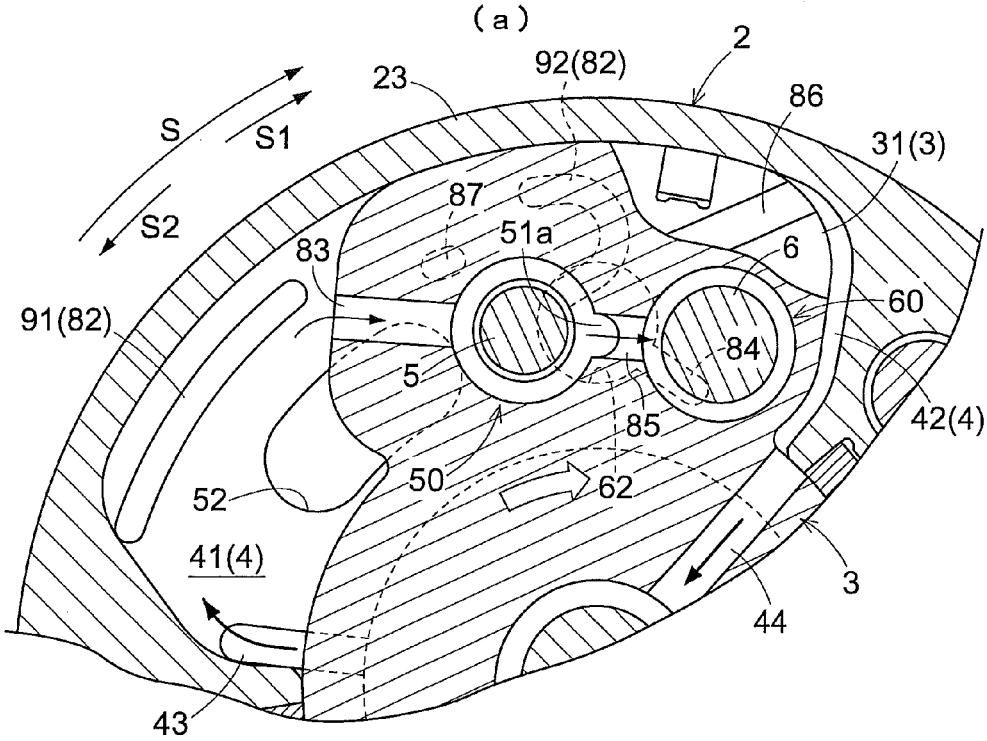
[FIG. 10] shows an advance angle control under a normal driving condition, with (a) being a plan view, (b) being a section view.
Figure 10:
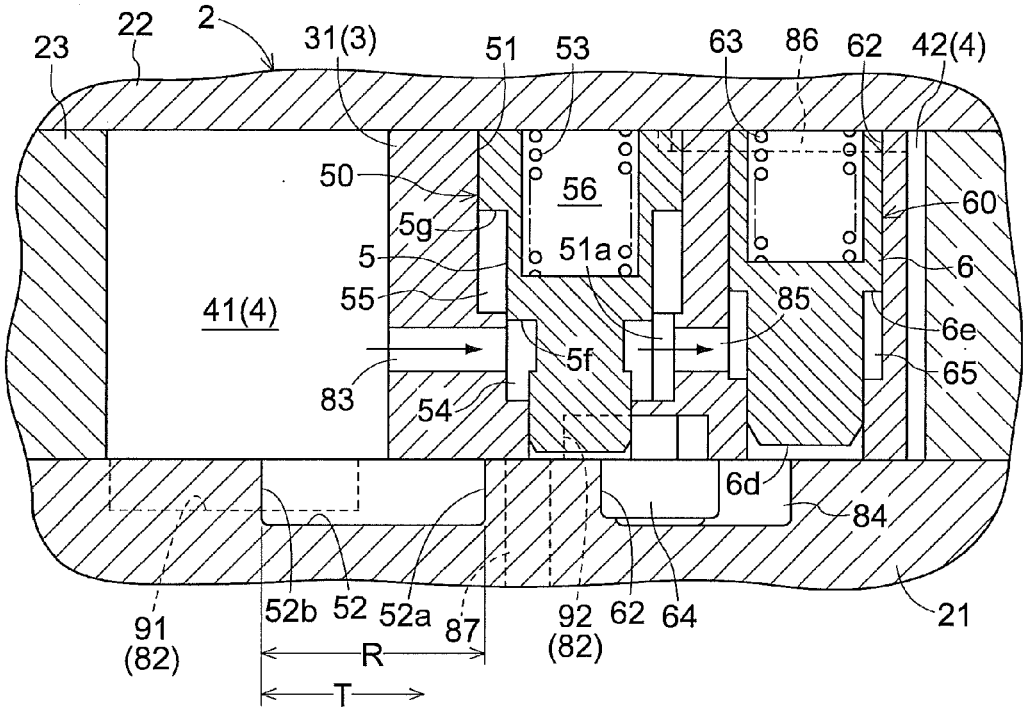

FIG. 10 shows a condition wherein the advance angle control is effected under the normal driving state. At the time of advance angle control, the advance angle chamber 41, the releasing-time communication passage 83, the first fluid chamber 54, the vertical groove portion 51*a*, the communication passage 85 and the fourth fluid chamber 65 are communicated to each other. Hence, the advance angle control is effected with the restriction released state and the locking released state being maintained.

Figure 11:
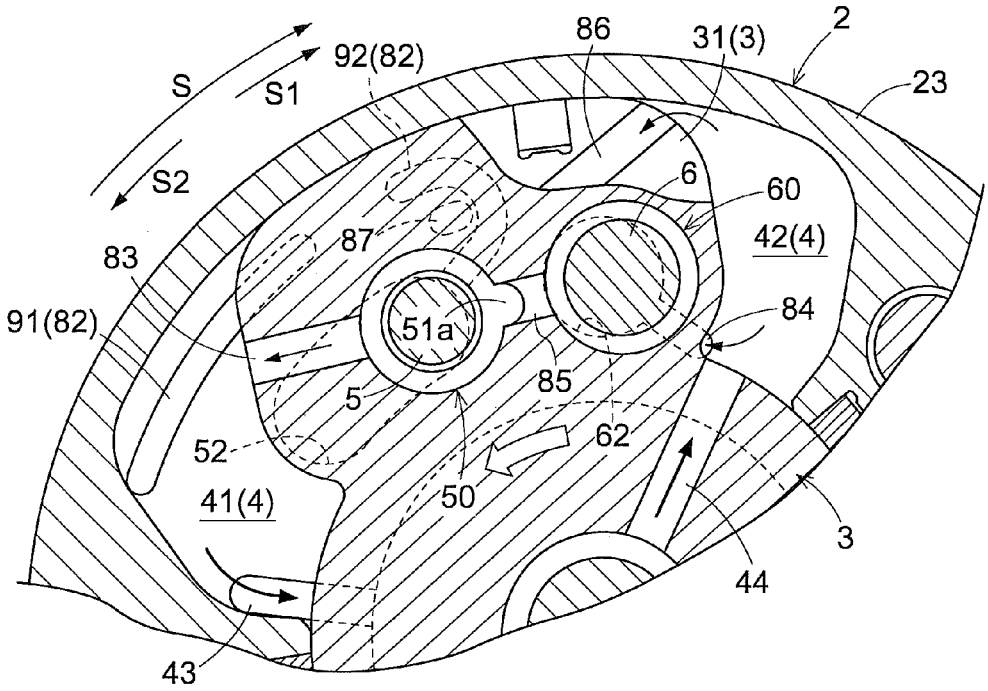
[FIG. 11] shows a retard angle control under the normal driving condition, with (a) being a plan view, (b) being a section view.
Figure 11:
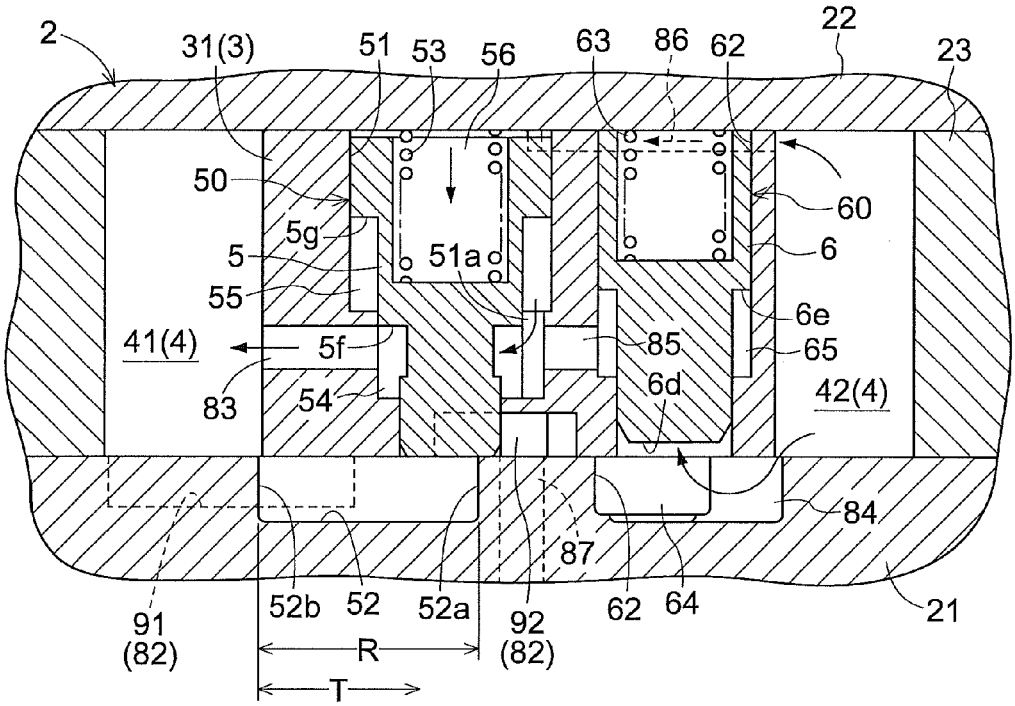

FIG. 11 shows a condition wherein the retard angle control is effected under the normal driving state. In this time, as fluid is fed from the retard angle chamber 42 to the third fluid chamber 64, the locking released state is maintained. On the other hand, since no fluid is fed to the first fluid chamber 54, the restricting member 5 is urged by the fluid fed from the urging passage 86 and the spring 53, thus coming into contact with the rear plate 21. During this operation, the fluid present inside the first fluid chamber 54, the second fluid chamber 55 and the vertical groove portion 51*a* are discharged via the releasing-time communication passage 83 to the advance angle chamber 41.

Incidentally, even when the restricting member 5 is urged to come into contact with the rear plate 21, as this restricting member 5 slides on the surface of the rear plate 21, the movement of the valve timing control apparatus 1 is not impaired. Moreover, since the restricting recess 52 and the locking recess 62 are formed at positions radially offset from each other, projection of the restricting member 5 into the locking recess 62 will not occur.

(Operations at Time of Restricting and Locking)

Lastly, the procedure for realizing the locked state after realization of the restricted state, namely, the procedure of shifting from the first state via the second state to the third state, will be explained with reference to FIG. 12 and FIG. 13.

When the unillustrated phase sensor detects the condition of the restricting mechanism 50 and the locking mechanism 60 respectively maintaining the restriction released state and the locking released state, namely, that under the first state, the restricting member 5 is present at a relative rotational phase which is inside the restriction range R and which also is outside the restriction releasable range T, the ECU 73 switches over to the retard angle control.

Figure 12:
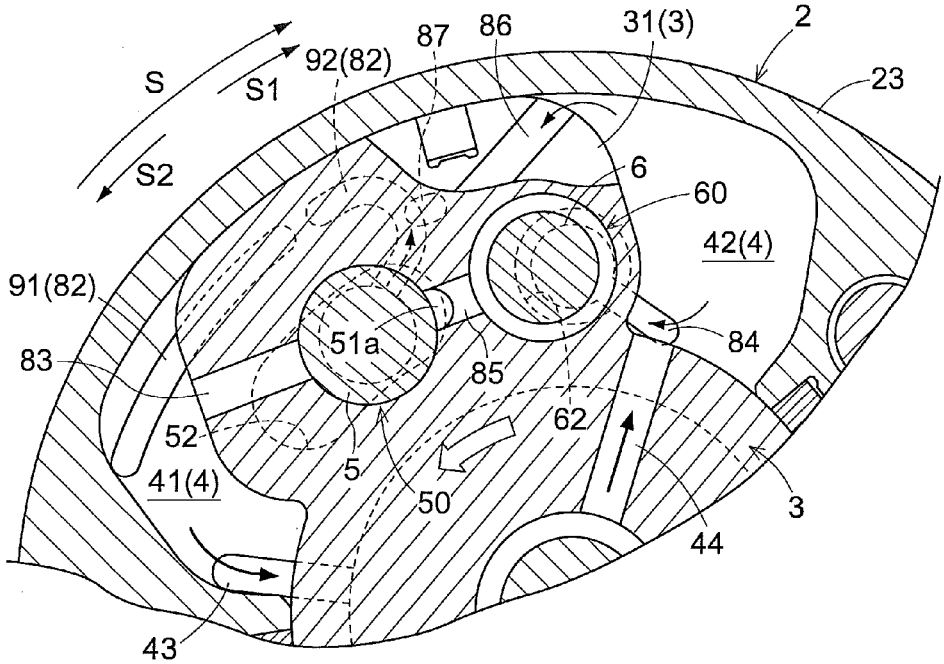
[FIG. 12] shows shifting from the first state to the second state, with (a) being a plan view, (b) being a section view.
Figure 12:
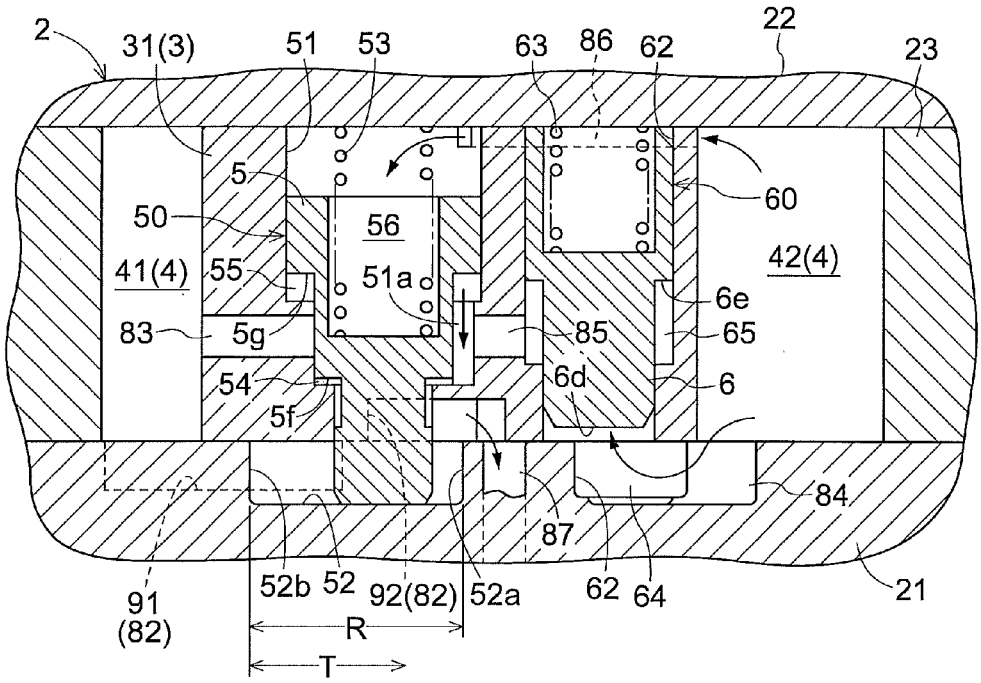

FIG. 12 shows a condition wherein the restricted state is realized with switching over to the retard angle control, that is, the conditions of the restricting mechanism 50 and the locking mechanism 60 under the second state. When the restricting member 5 is caused to project into the restricting recess 52 in this way, the restricting member 5 is urged toward the rear plate 21 side by the fluid fed to the back face fluid chamber 56 from the urging passage 86 and the spring 53 and also communication is established between the U-shaped passage 92 and the drain passage 87, whereby the fluid present inside the first fluid chamber 54, the second fluid chamber 55 and the vertical groove portion 51*a* is discharged from the drain passage 87, so that the restricting member 5 can project into the restricting groove 52 speedily.

If the retard angle control is maintained after realization of the restricted state, the restricting member 5 will move into the restriction releasable range T and the rear plate passage 91 and the U-shaped passage 92 are communicated to each other. Hence, the restricted state will be released inadvertently at the time of next switchover to the advance angle control. For this reason, after realization of the restricted state, it is necessary to switch over to the advance angle control before the restricting member 5 moves into the restriction releasable range T.

Figure 13:
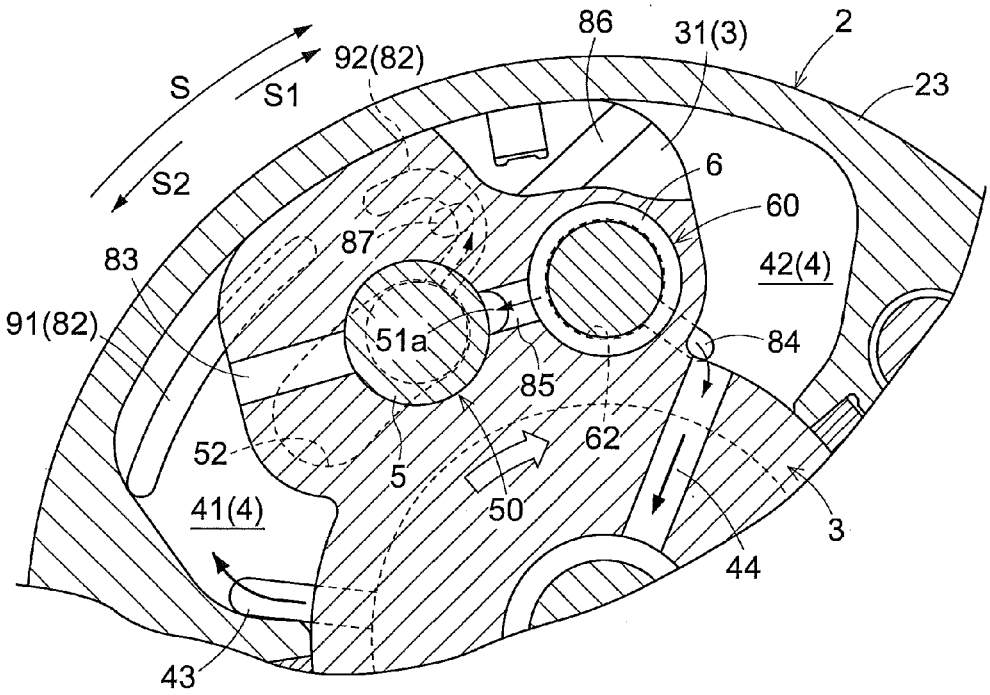
[FIG. 13] shows shifting from the second state to the third state, with (a) being a plan view, (b) being a section view.
Figure 13:
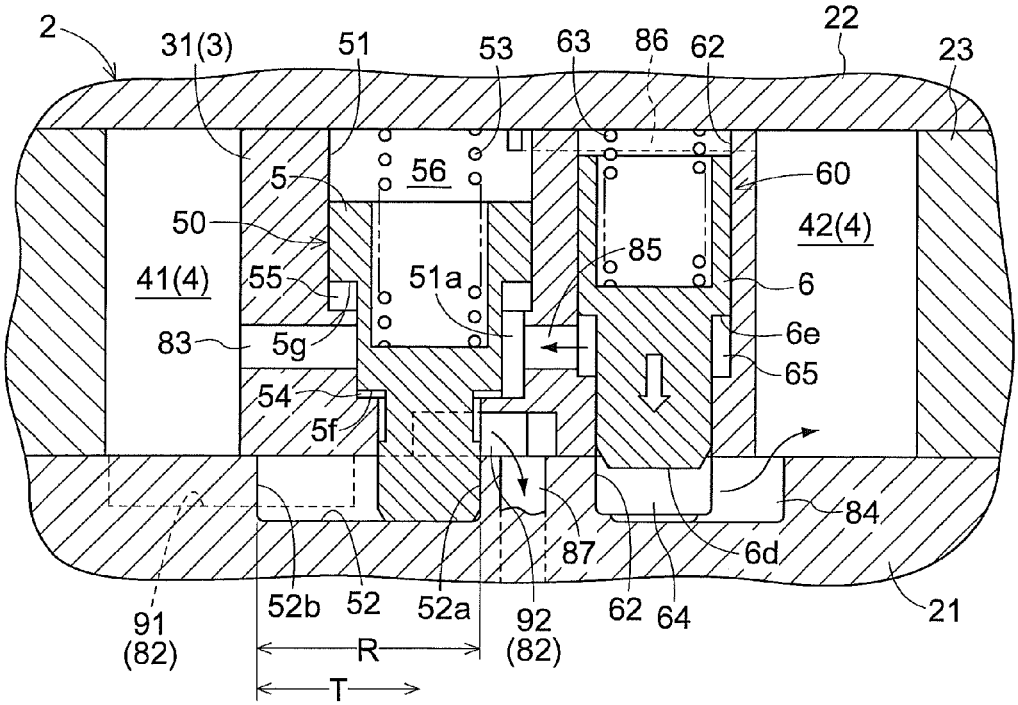

If the control is switched over to the advance angle control before the restricting member 5 moves into the restriction releasable range T, as shown in FIG. 13, the restricting member 5 effects an advance angle movement rather than retracting from the restricting recess 52. As a result, the restricting member 5 comes into contact with the first end portion 52*a* of the restricting recess 52, thus being maintained at the intermediate locked phase. In this time, as the fluid feeding to the communication passage 85 is blocked, the locking member 6 is urged by the spring 63 to project into the locking recess 62, whereby the locked state illustrated in FIG. 6, that is, the third state is realized. In this, the fluid present inside the third fluid chamber 64 will be discharged from the retard angle chamber 42 via the lock releasing passage 84 and the fluid present inside the fourth fluid chamber 65 will be discharged via the communication passage 85, the vertical groove portion 51*a*, the first fluid chamber 54, the U-shaped passage 92 and the drain passage 87, so that projecting movement of the locking member 6 is not prevented.

As described above, in the instant embodiment, with the advance/retard angle control, switchovers between the first state, the second state and the third state are made possible. Therefore, even if the locked state is not realized as a result of failure of the operations of the restricting member 5 and the locking member 6 as expected, the advance/retard angle control can be effected again in order to realize the locked state.

As described above, with provision of the urging passage 86, it is possible to cause the restricting member 5 to project into the restricting recess 52 even more speedily. Therefore, since the shifting from the first state to the second state can proceed speedily, even if the range in which the rear plate passage 91 and the U-shaped passage 92 are not communicated (the range resulting when the restriction releasable range T is subtracted from the restriction range R) is rendered narrower, the locked state can be easily realized at the time of engine stop. Consequently, in the course of shifting from the third state to the second state at the time of engine start, the retard angle control for establishing communication between the rear plate passage 91 and the U-shaped passage 92 can be effected only for a short period of time. Hence, there is achieved a further advantage that the period required for shifting to the normal driving can be shortened.

Incidentally, in the instant embodiment, the restricting mechanism 50 is disposed on the more retard angle side than the locking mechanism 60. However, the mechanism 50 may be disposed on more advance angle side than the same. In this, with reversal between the term "advance angle" and the term "retard angle" as used therein, the locked state can be realized before engine stop, just like the instant embodiment.

[Other Embodiment]

In the foregoing embodiment, for the end of speedy release of the restricted state through restriction of the influence of residual pressure of the fluid present inside the back side fluid chamber 56, the minimum cross section areas of the retard angle passage 44 and the urging passage 86 are respectively set larger than the minimum cross section area of the advance angle passage 43. However, in place of such arrangement, between the valve timing control apparatus 1 and the advance/retard angle control valve 72, the minimum cross section area of the retard angle connection passage 46 may be set larger than the minimum cross section area of the advance angle connection passage 45.

INDUSTRIAL APPLICABILITY

The present invention is applicable to a valve timing control apparatus and a valve timing control mechanism that can realize the locked state speedily prior to engine stop through controlling a restricting mechanism and a locking mechanism during engine operation and that can dispense with a switching valve dedicated to controlling of the restricting mechanism and the locking mechanism.

REFERENCE SIGNS LIST

1 valve timing control apparatus
2 outer rotor (driving-side rotary member)
3 inner rotor (driven-side rotary member)
4 fluid pressure chamber
5 restricting member
6 locking member
9 cam shaft
11 crankshaft
12 engine (internal combustion engine)
31 partitioning portion
41 advance angle chamber
42 retard angle chamber
43 advance angle passage (passage for feeding fluid to advance angle chamber)
44 retard angle passage (passage for feeding fluid to retard angle chamber)
45 advance angle connection passage (passage between advance/retard angle control valve and advance angle chamber)
46 retard angle connection passage (passage between advance/retard angle control valve and retard angle chamber)
52 restricting recess
62 locking recess
71 pump
72 advance/retard angle control valve
75 check valve
81 restriction releasing passage
82 restricting-time communication passage (restriction releasing passage)
83 releasing-time communication passage (restriction releasing passage)
84 lock releasing passage
85 communication passage
86 urging passage
100 valve timing control mechanism

The invention claimed is:

1. A valve timing control apparatus comprising:

a driving-side rotary member rotatable in synchronism with a crankshaft of an internal combustion engine;

a driven-side rotary member disposed coaxial with the driving-side rotary member and rotatable in synchronism with a valve opening/closing cam shaft of the internal combustion engine;

a fluid pressure chamber formed by the driving-side rotary member and the driven-side rotary member;

a partitioning portion provided in at least one of the driving-side rotary member and the driven-side rotary member for partitioning the fluid pressure chamber into an advance angle chamber and a retard angle chamber;

a restricting member provided in at least one of the driving-side rotary member and the driven-side rotary member and projectable and retractable relative to the other of the driving-side rotary member and the driven-side rotary member;

a restricting recess formed in the other rotary member and restricting a relative rotational phase of the driven-side rotary member relative to the driving-side rotary member to a range from one of a most advanced angle phase and a most retarded angle phase to a predetermined phase in association with projection of the restricting member therein;

a locking member disposed in the one rotary member having the restricting member, the locking member being projectable and retractable relative to the other rotary member;

a locking recess formed in the other rotary member and locking the relative rotational phase of the driven-side rotary member relative to the driving-side rotary member to the predetermined phase in association with projection of the locking member therein;

a communication passage formed between the restricting member and the locking member; and an urging passage for feeding fluid for projecting the restricting member into the restricting recess;

wherein the valve timing control apparatus is switchable into a first state for releasing the locking by the locking member and the restriction by the restricting member with feeding of the fluid into the communication passage, a second state for restricting the restricting member and releasing the locking by the locking member with non-feeding of the fluid to the communication passage and feeding of the fluid to the urging passage and a third state for restricting the restricting member and locking the locking member with feeding of the fluid neither to the communication passage nor to the urging passage.

2. The valve timing control apparatus according to claim 1, wherein the communication passage receives the feeding of fluid in association with establishment of communication thereof with one of the advance angle chamber and the retard angle chamber, and the urging passage receives the feeding of fluid in association with establishment of communication thereof with the other of the advance angle chamber and the retard angle chamber.

3. The valve timing control apparatus according to claim 2, further comprising:

a restriction releasing passage communicated with the one of the advance angle chamber and the retard angle chamber and feeding fluid for releasing the restriction by the restricting member; and a lock releasing passage communicated with the other of the advance angle chamber and the retard angle chamber and feeding fluid for releasing the locking by the locking member.

4. The valve timing control apparatus according to claim 3, wherein:

the restriction releasing passage includes:

a restricting-time communication passage which is communicated with the one of the advance angle chamber and the retard angle chamber so as to feed fluid for releasing restriction by the restricting member when the restricting member projects into the restricting recess; and a releasing-time communication passage which is communicated with the one of the advance angle chamber and the retard angle chamber so as to feed fluid for releasing restriction by the restricting member when the restricting member is retracted from the restricting recess.

5. The valve timing control apparatus according to claim 4, wherein the restricting-time communication passage is non-communicated with the one of the advance angle chamber and the retard angle chamber when the driving-side rotary member and the driven-side rotary member are present within a predetermined phase displaced toward one of the most advanced angle phase and the most retarded angle phase from the predetermined phase.

6. The valve timing control apparatus according to claim 2, wherein the passage feeding fluid to the other of the advance angle chamber and the retard angle chamber or the urging passage has a minimum cross section area larger than a minimum cross section area of the passage feeding fluid to the one of the advance angle chamber and the retard angle chamber.

7. A valve timing control mechanism comprising:

the valve timing control apparatus according to claim 2; and an advance/retard angle control valve for switching over which of the advance angle chamber and the retard angle chamber the fluid is to be fed;

wherein the passage between the advance/retard angle control valve and the other of the advance angle chamber and the retard angle chamber has a minimum cross section area larger than a minimum cross section area of the passage between the advance/retard angle control valve and the one of the advance angle chamber and the retard angle chamber.

8. A valve timing control mechanism comprising:

the valve timing control apparatus according to claim 1;

a pump for feeding fluid to the valve timing control apparatus;

an advance/retard angle control valve for switching over which of the advance angle chamber and the retard angle chamber the fluid is to be fed; and a check valve disposed between the pump and the advance/retard angle control valve for checking flow of fluid to the pump.

* * * * *